United States Patent [19]

Weber

[11] 4,303,132

[45] Dec. 1, 1981

[54] SAFETY DEVICE FOR ROTARY EARTH DRILLING APPARATUS

[75] Inventor: William J. Weber, Claremont, N.H.

[73] Assignee: Joy Manufacturing Company, Pittsburgh, Pa.

[21] Appl. No.: 118,363

[22] Filed: Feb. 4, 1980

[51] Int. Cl.[3] ..... B23Q 5/027; B23Q 5/033

[52] U.S. Cl. ..... 173/147

[58] Field of Search ..... 173/147, 156; 188/67, 188/82.7; 299/24

[56] References Cited

U.S. PATENT DOCUMENTS

| | | | |
|---|---|---|---|
| 2,338,625 | 1/1944 | Curtis | 173/147 X |
| 2,564,188 | 8/1951 | Burge et al. | 173/147 |
| 3,973,634 | 8/1976 | Persson et al. | 173/147 |
| 4,020,909 | 5/1977 | Airaudo | 173/147 |
| 4,124,081 | 11/1978 | Deike | 173/147 X |
| 4,191,263 | 3/1980 | Malterer | 173/147 |

*Primary Examiner*—Ronald Feldbaum

*Attorney, Agent, or Firm*—Thomas H. Murray

[57] ABSTRACT

A safety device for a drilling rig of the type wherein a drill-carrying cradle is caused to move upwardly or downwardly on a tower by a chain which traverses sprockets at opposite ends of the tower. Shock loads and vibration cause premature failures in the chain when withdrawing a drill string as the cradle is pulled upwardly on the tower. The present invention minimizes shock loads on the chain to minimize the possibility of a chain failure and, at the same time, prevents a fall of the cradle and drill carried thereby if the chain above it should break, this latter function being accomplished with the use of spring-loaded toothed dogs on the cradle which engage the tower and prevent movement of the cradle in the event of a chain failure.

8 Claims, 7 Drawing Figures

III
III
14
25
24
18
16
20
10
12
26
28

76
14
25
22
26
24
18
28
16
10
20
12
29
18
16
20
12

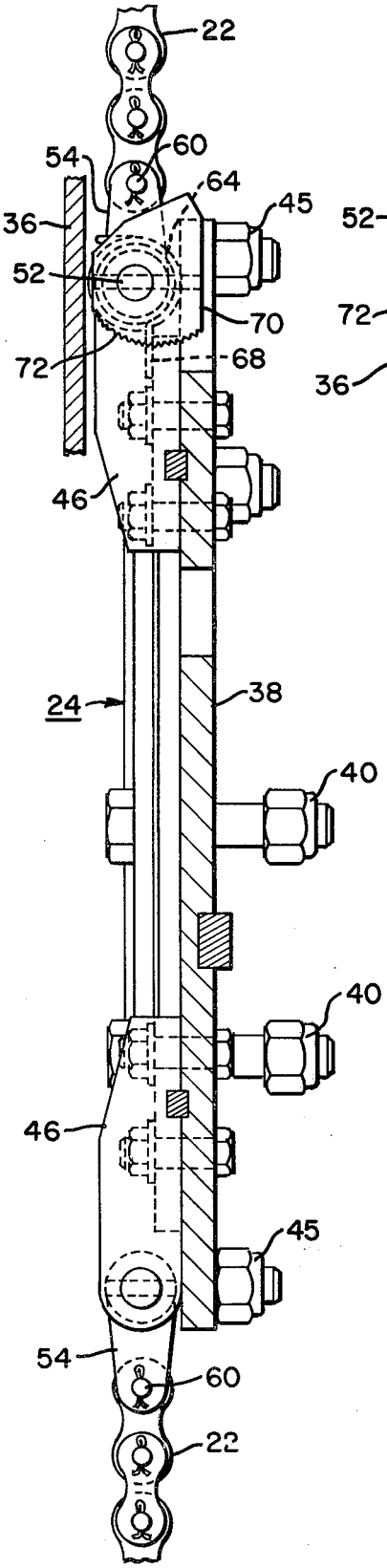
Fig. 5
Fig. 5A
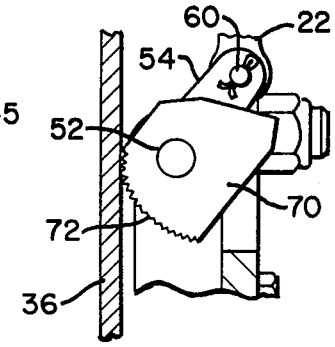
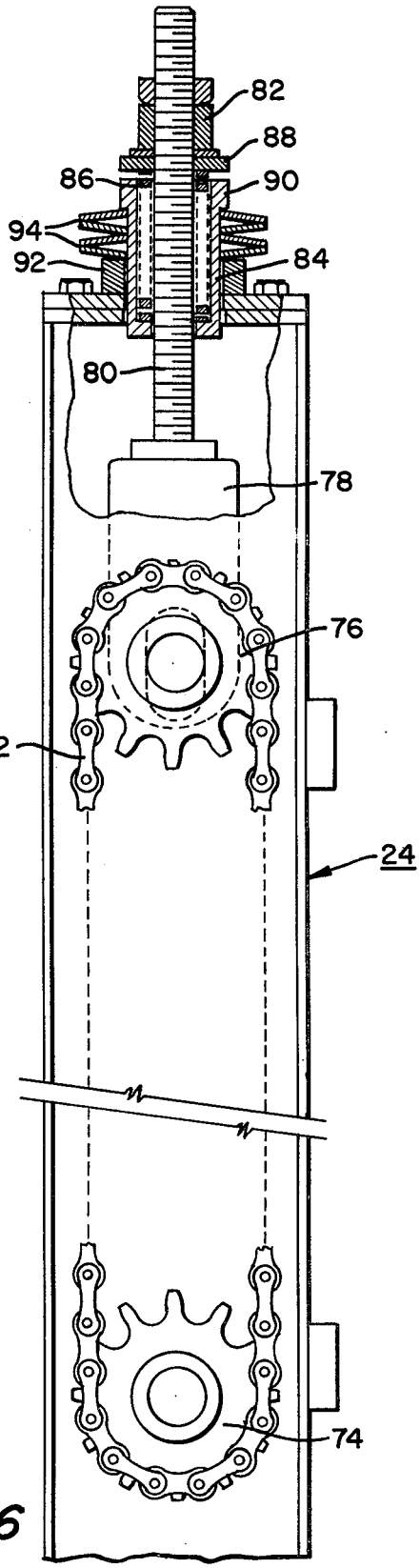
Fig. 6

SAFETY DEVICE FOR ROTARY EARTH DRILLING APPARATUS

BACKGROUND OF THE INVENTION

In rotary and/or percussion earth drilling apparatus, it is common to mount a drill motor on a cradle which can reciprocate on a vertical drill tower, the cradle and drill motor being moved upwardly or downwardly on the tower by a chain which passes around sprockets at opposite ends of the tower and is driven by a suitable drive motor. In drilling apparatus of this type, shock loads and vibration can cause premature failure in the length of chain above the drill-carrying cradle when withdrawing a drill string from the earth. A break in the upper reach of the chain is most likely to occur since during normal drilling operations the drill motor is being pulled downwardly by the chain and the upper reach of the chain is at a relatively low tension; whereas during withdrawal of the drill string, the chain is under relatively greater tension. If the chain should break during the withdrawal process, the cradle and drill may fall, causing injury to operating personnel.

SUMMARY OF THE INVENTION

In accordance with the present invention, a safety device for earth drilling equipment and the like is provided which minimizes shock loads on the chain which carries a drill and also prevents dropping of the drill and cradle on which it is carried in the event of a chain failure.

In a specific embodiment of the invention, the means for preventing dropping of the cradle and the drill comprises a U-shaped member secured to a shaft pivotally carried on the cradle. This U-shaped member has a pair of spaced legs pivotally mounted on a pin at an end of the chain which pulls the cradle upwardly. A torsion spring urges the shaft and the U-shaped member to rotate from a position where the U-shaped member is aligned with the chain, while it is under tension, to a position where the U-shaped member is approximately at right angles to the path of travel of the chain when it breaks and is not under tension. At least one toothed dog is secured to the spring-loaded shaft and is rotatable therewith under the force of the torsion spring to engage the tower and secure the cradle against downward movement until tension is again restored to the chain.

In order to maintain chain tension and to minimize shock loads on the chain and thereby increase its useful life, one of the sprockets at the end of the tower which is traversed by the chain is spring-loaded by two springs in series, a coil spring to maintain chain tension and Belleville washers to absorb shock and vibration loads.

The above and other objects and features of the invention will become apparent from the following detailed description taken in connection with the accompanying drawings which form a part of this specification, and in which:

FIG. 5 is a cross-sectional view taken substantially along line V—V of FIG. 4;

FIG. 5A is a broken-away view of the toothed dog arrangement of the invention showing it in its engaged position; and FIG. 6 is a side view of the drill tower utilized in the apparatus of FIGS. 1 and 2 showing the means for absorbing shock loads and maintaining tension on the drive chain for the drill motor.

Figure 1:
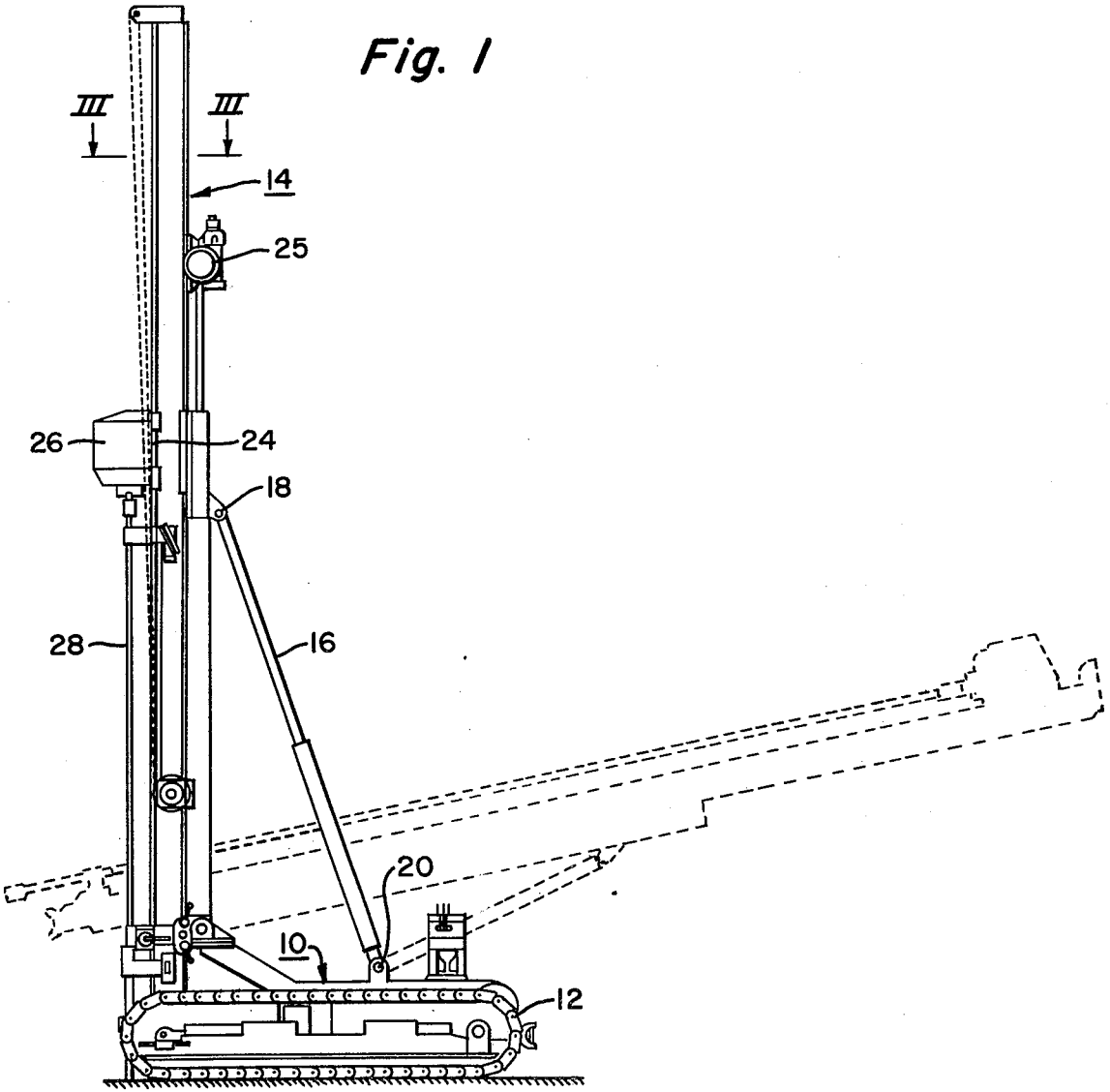
FIG. 1 is a side view of rotary percussion earth drilling apparatus with which the present invention may be employed.
Figure 2:
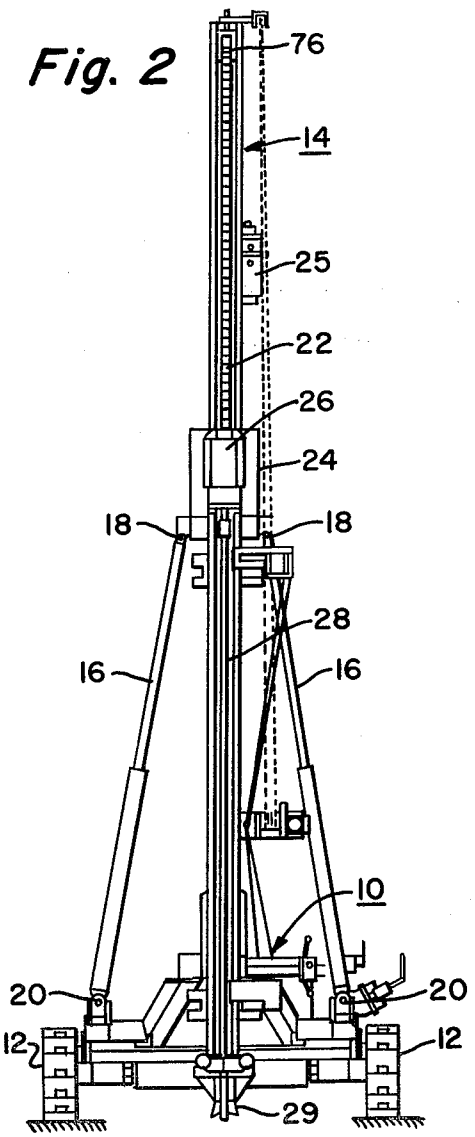
FIG. 2 is an end view of the apparatus shown in FIG. 1.

With reference now to the drawings, and particularly to FIGS. 1 and 2, the rotary earth drilling apparatus shown comprises a frame 10 mounted on cats 12 which can traverse the ground surface. Pivotally connected to the forward end of the frame 10 is a drill tower 14. The drill tower 14 can rotate about its pivotal connection to the frame 10 from the generally vertical position shown to an almost horizontal position (i.e., the broken-line position shown in FIG. 1). The position of the tower 14 is controlled by hydraulic cylinders 16 pivotally connected to the tower at 18 and to the frame 10 at 20. That is, by expanding the hydraulic cylinders 16, the tower 14 is moved into the vertical position shown; and by retracting the cylinders 16, the tower 14 can be rotated about its pivotal connection to the frame 10 in a clockwise direction as viewed in FIG. 1 into an almost horizontal position. The drilling apparatus, therefore, can be used to drill holes into the earth at various angles with respect to the earth's surface.

At the top and bottom of the drill tower 14 are sprockets, hereinafter described with reference to FIG. 6. Passing around the sprockets is a chain 22 connected at its one end to the top of a cradle 24 and at its other end to the bottom of the same cradle. Thus, the chain extends from the top of the cradle 24 around a sprocket at the top of the tower, thence downwardly through sprockets driven by a drive motor 25 and finally around the sprocket at the bottom of the tower, its other end being connected to the bottom of the cradle 24. Rotation of the drive motor 25 in one direction will cause upward movement of the chain and the cradle 24; while rotation of the drive motor in the opposite direction will cause downward movement of the cradle.

Carried on the cradle 24 is a pneumatic drill drive motor 26 which rotates a drill rod 28. At the same time the motor 26 constantly striking the top of the rod 28, as is conventional. During a drilling operation, the drill rod 28 is rotated and continually struck by the motor 26; and as a bit 29 at its lower end penetrates the earth, the motor 25 is actuated to lower the cradle, the drive motor 26 and the drill rod 28. After a hole has been drilled to the desired depth, it is then necessary to reverse the movement of the chain 22, whereupon the cradle 24 and motor 26 are pulled upwardly and the drill rod 28 withdrawn from the drilled hole.

As was explained above, shock loads on the chain 22 which carries the cradle 24 may occur as the drill rod 28 is withdrawn from the earth. Furthermore, these shock loads can materially decrease the useful life of the chain and cause breakage of the chain above the cradle 24. When such a breakage occurs, it is possible for the cradle 24, the motor 26 and the drill rod 28 to drop and cause injury to operating personnel or other damage.

Figure 3:
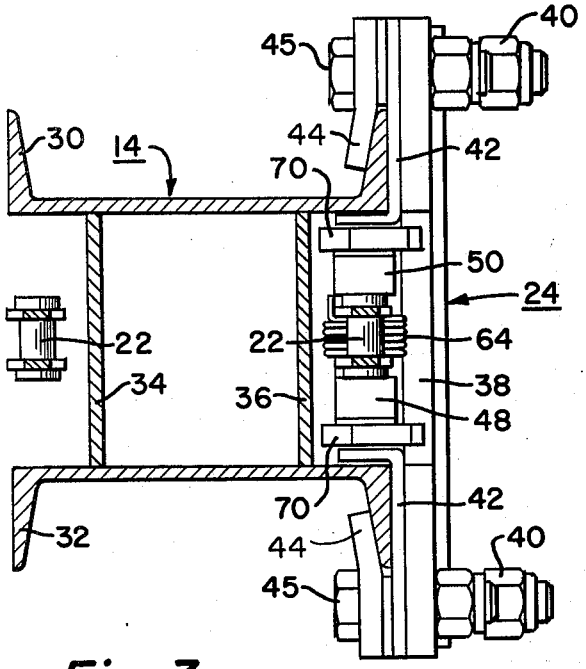
FIG. 3 is a cross-sectional view taken substantially along line III—III of FIG. 1 showing the drill motor-carrying cradle employed in the earth drilling apparatus of FIGS. 1 and 2 and incorporating the safety device of the present invention.
Figure 4:
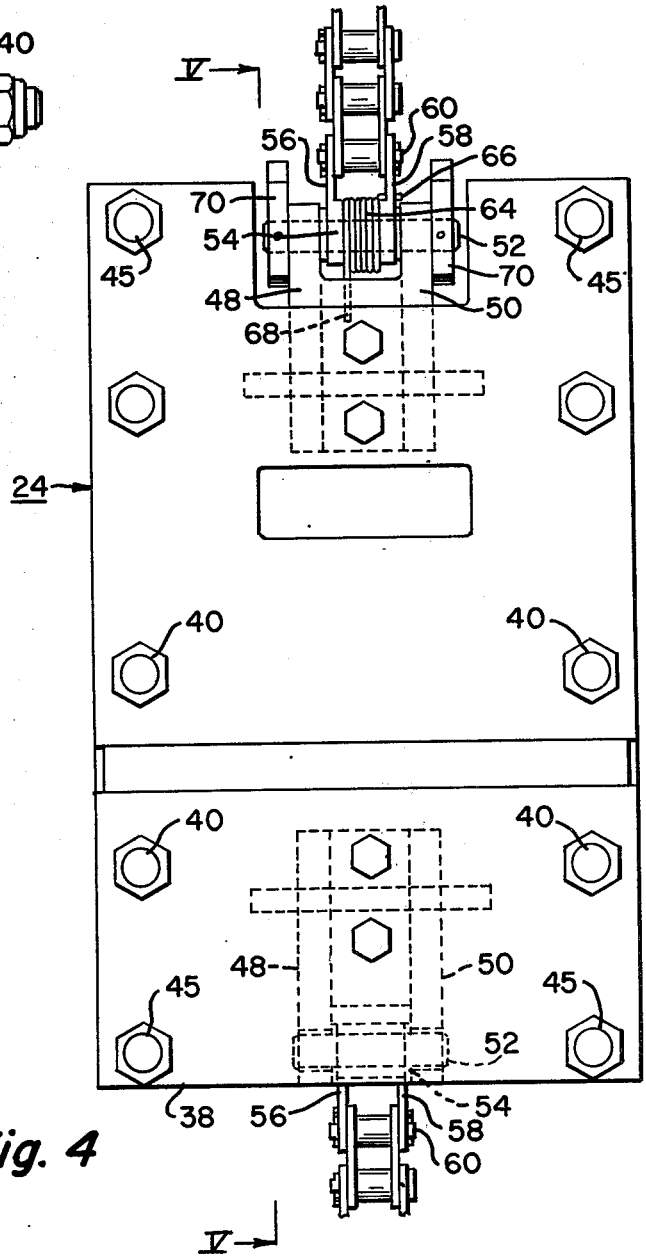
FIG. 4 is a plan view of the rock drill motor-carrying cradle having the safety device of the invention incorporated therein.

The apparatus for preventing dropping of the cradle 24 when the upper reach of the chain 22 breaks is shown in FIGS. 3–5; while the apparatus for minimizing shock loads on the chain is shown in FIG. 6. In FIG. 3, a cross-sectional view of the tower 14 is shown looking downwardly on the cradle 24. The tower 14 comprises a pair of steel channels 30 and 32 interconnected by welded plates 34 and 36. As shown in FIG. 4, the cradle 24 comprises a mounting plate 38 to which is bolted the drill drive motor 26 (not shown in FIGS. 3 and 4) by means of mounting bolts 40. At opposite ends of the plate 38 are L-shaped shoes 42 (FIG. 3) which ride on one side of the forward flange of each channel 30 or 32 and rear shoes 44 which ride on the back surface of the same flanges, shoes 42 and 44 being drawn into snug-abutting relationship with opposite sides of their respective flanges by means of bolts 45.

Beneath the plate 38, at its opposite ends, are fixtures 46 (FIG. 5) having spaced legs 48 and 50 (FIG. 4) to which the ends of the chain 22 are connected. In this regard, a shaft 52 passes through the legs 48 and 50 and carries a generally U-shaped element 54 having spaced legs 56 and 58 connected to a pin 60 in each end of the chain 22. The lower reach of the chain 22 is simply connected to the shaft 52; however the U-shaped member 54 for the upper reach of the chain is secured to the shaft 52 and is surrounded by a torsion spring 64, one end of which underlies the leg 58 of the U-shaped member 54 at 66 and the other end of which underlies the fixture 46 at 68. With the arrangement shown, it will be appreciated that, as viewed in FIG. 5, the torsion spring 64 will tend to rotate the U-shaped member 54 in a clockwise direction. However, as long as tension is on the chain 22, the U-shaped member will remain aligned with the path of travel of the chain against the force of the torsion spring 64. On the other hand, if the chain 22 should break above the cradle 24, the chain will no longer be under tension and the torsion spring will cause the U-shaped member 54 and the shaft 52 to rotate in a clockwise direction as viewed in FIG. 5.

Pinned to opposite ends of the shaft 52 are toothed dogs 70 which, of course, will rotate in a clockwise direction also when there is no longer tension in the upper reach of the chain 22. When this occurs, the toothed portions 72 (FIG. 5) on the dogs 70 will rotate backwardly to engage the plate 36, thereby breaking what would otherwise be the fall of the cradle 24 and the drill motor 26 carried thereby. Hence, if the chain 22 should break above the cradle 24, the toothed dogs 70 will act as brakes and prevent movement of the cradle.

In FIG. 6, sprockets 74 and 76 at the lower and upper ends of the tower 14 are shown. The lower sprocket 74 is simply journaled in bearings; whereas the upper sprocket 76 is carried on a member 78 having a threaded shaft 80 projecting from its upper end. The threaded shaft 80, in turn, is threaded into a nut 82 mounted on top of a generally cylindrical housing 84 through which the threaded shaft 80 extends. Carried within the housing 84 and surrounding the shaft 80 is a coil spring 86 which extends between the bottom of the housing 84 and a washer 88 which bears against the nut 82.

The outer periphery of the housing 84 is provided with an enlarged diameter portion 90 and between the portion 90 and a collar 92 which bears upon the top of the tower 14 is a series of Belleville washers 94. Except for the Belleville washers, the housing 84, the shaft 80 and the member 78 can move downwardly within the collar 92. Thus, when shock loads are imposed on the chain 22, these shock loads will be transmitted through the sprocket 76 to the member 78 and the shaft 80 to the Belleville washers 94 which absorb those shocks and hence, prolong the life of the chain 22.

It will be appreciated that the spring loading imposed by springs 86 and Belleville washers 94 on the upper sprocket 76 assures that sufficient tension will be maintained in the upper reach of the chain 22 during drilling operations, when cradle 24 moves downwardly, to maintain dogs 70 in disengaged positions. The nut 82 permits selective adjustment to provide the desired pre-tension in the chain.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a rotary and/or percussion drilling rig of the type having a vertically-extending tower provided with a guideway for a drill-carrying cradle, sprocket means at opposite ends of said tower, and chain means movable around said sprocket means and connected to said cradle whereby movement of the chain means will cause vertical movement of the cradle and a drill carried thereby; the improvement in said drilling rig of means for preventing said cradle and a drill carried thereby from dropping in the event of breakage of said chain means, said improvement comprising:

a connecting member secured to a shaft pivotally carried on said cradle and having leg means pivotally connected to an end of said chain means, torsion spring means urging said shaft and said connecting member to rotate from a position where the connecting member is aligned with the chain means while it is under tension, and at least one toothed dog secured to said shaft and rotatable with the shaft under the force of said torsion spring means to engage said tower and secure the cradle against movement until tension is again restored to the chain means.

2. The improvement of claim 1 wherein said connecting member comprises a U-shaped member having spaced legs pivotally connected to a pin at an end of the chain means.

3. The improvement of claim 2 wherein said shaft which carries said U-shaped member is at the top of said cradle.

4. The improvement of claim 2 wherein said shaft is secured to a body portion of said U-shaped member which interconnects said spaced legs, and said torsion spring means surrounds said body portion.

5. The improvement of claim 4 in which at least two toothed dogs are secured to opposite ends of said shaft on opposite sides of said U-shaped member.

6. The improvement of claim 4 in which said tower comprises channel members interconnected by plate members, and wherein said toothed dogs engage one of said plate members when the chain means is not under tension.

7. The improvement of claim 1 including spring means urging a sprocket means at one end of the tower in a direction to maintain tension in the chain means.

8. The improvement of claim 7 including Belleville washers in combination with said spring means for absorbing shock loads on the chain means.

* * * * *